US008172647B2

(12) United States Patent
Davis et al.

(10) Patent No.: US 8,172,647 B2
(45) Date of Patent: May 8, 2012

(54) POLISH PAD CONDITIONING IN MECHANICAL POLISHING SYSTEMS

(75) Inventors: Eugene C. Davis, McKinney, TX (US); Gul Bahar Basim, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 633 days.

(21) Appl. No.: 12/274,140

(22) Filed: Nov. 19, 2008

(65) Prior Publication Data

US 2010/0124871 A1 May 20, 2010

(51) Int. Cl.
*B24B 1/00* (2006.01)

(52) U.S. Cl. ..... 451/56; 451/41; 451/285; 451/287; 451/443

(58) Field of Classification Search ..... 451/41, 451/56, 285, 287, 443, 446
See application file for complete search history.

(56) References Cited

U.S. PATENT DOCUMENTS

| | | | | |
|---|---|---|---|---|
| 5,651,725 | A * | 7/1997 | Kikuta et al. | 451/41 |
| 6,116,993 | A * | 9/2000 | Tanaka | 451/287 |
| 6,315,643 | B1 * | 11/2001 | Hiyama et al. | 451/60 |
| 6,806,193 | B2 | 10/2004 | Korthuis et al. | |
| 7,344,987 | B2 | 3/2008 | Leng et al. | |
| 2007/0026769 | A1 * | 2/2007 | Davis et al. | 451/41 |

* cited by examiner

*Primary Examiner* — Eileen P. Morgan
(74) *Attorney, Agent, or Firm* — Alan A. R. Cooper; Wade James Brady, III; Frederick J. Telecky, Jr.

(57) ABSTRACT

A mechanical polishing apparatus includes a polishing pad, at least one carrier head positioned over and off center relative to the polishing pad and configured for holding at least one substrate against the polishing pad within a first annular region of the polishing pad when the polishing pad is rotating. At least one conditioning head is positionable over and off center relative the polishing pad at a plurality of first positions and configured for applying a contacting surface of at least one conditioning pad against the polishing pad when the polishing pad is rotating, where the conditioning pad is applied to a second annular region of the polishing pad and moves between the plurality of first positions. In the apparatus, the diameter of the conditioning pad≦a difference between a radius of the polishing pad and a width of the first annular region.

20 Claims, 6 Drawing Sheets

POLISH PAD CONDITIONING IN MECHANICAL POLISHING SYSTEMS

FIELD OF THE INVENTION

The present invention relates to mechanical polishing systems and more particularly, to polish pad conditioning in mechanical polishing systems.

BACKGROUND

Planarizing or polishing processes, such as chemical mechanical polishing (CMP), are essential processes in the manufacture of most advanced integrated circuits (ICs). In general, layers used in IC fabrication must be made extremely planar and of precise thicknesses in order to reliably pattern the various sub-micron sized features that commonly comprise modern semiconductor devices. CMP, a combination of chemical etching and mechanical abrasion processes, is one method of providing the planar surfaces required for such advanced IC manufacturing processes.

Such polishing processes can also include a conditioning step in which a pad conditioner is used to abrade the top surface of the polishing pad and remove by-products from the polishing process and/or open pores in the polishing pad to sustain a polishing rate. Pad conditioning is typically performed using an abrasive material mounted on a disk and applied to the polishing pad. In general, the pad conditioning process can either be performed in-situ (i.e., at the same time the wafer is being polished) or ex-situ (i.e., between processing of wafers).

SUMMARY

This Summary is provided to comply with 37 C.F.R. §1.73, presenting a summary of the invention to briefly indicate the nature and substance of the invention. It is submitted with the understanding that it will not be used to interpret or limit the scope or meaning of the claims.

In a first embodiment of the present invention a mechanical polishing apparatus is provided. The apparatus includes a polishing pad, at least one carrier head positioned over and off center relative to the polishing pad and configured for holding at least one substrate against the polishing pad within a first annular region of the polishing pad when the polishing pad is rotating, and at least one conditioning head positionable over and off center relative the polishing pad at a plurality of first positions and configured for applying a contacting surface of at least one conditioning pad against the polishing pad when the polishing pad is rotating. In the apparatus the conditioning pad is applied to a second annular region of the polishing pad and moves between the plurality of first positions and the diameter of the conditioning pad ≦a difference between a radius of the polishing pad and a width of the first annular region.

In a second embodiment of the present invention, a method for fabricating an integrated circuit is provided. The method includes providing at least one substrate having a polishable surface and polishing the substrate. The polishing step includes placing the substrate in a carrier head positioned over and off center relative to a polishing pad at a first position and configured for holding the substrate against the polishing pad within a first annular region of the polishing pad when the polishing pad is rotating. The polishing step also includes rotating the polishing pad and applying at least one conditioning head over and off center relative to the polishing pad at a plurality of first positions and configured for applying a contacting surface of at least one conditioning pad against the polishing pad. In the method, the conditioning pad is applied to a second annular region of the polishing pad and moves between the plurality of first positions, where the diameter of the conditioning pad≦a difference between a radius of the polishing pad and a width of the first annular region.

In a third embodiment of the present invention, A method for configuring a chemical mechanical polishing (CMP) apparatus is provided. The CMP apparatus includes a polishing pad, at least one carrier head positioned over and off center relative to the polishing pad, and at least one conditioning head positionable over and off center relative the polishing pad at a plurality of first positions. In the CMP apparatus, the carrier head is configured for holding at least one substrate against the polishing pad within a first annular region of the polishing pad when the polishing pad is rotating and the conditioning head is configured for applying a contacting surface of at least one installed conditioning pad against the polishing pad when the polishing pad is rotating. The installed conditioning pad is applied to a second annular region of the polishing pad and moves between the plurality of first positions. The method includes selecting a diameter for a conditioning pad to be installed in the CMP apparatus based on a radius of the polishing pad and a width of the first annular region, where the diameter of the conditioning pad≦a difference between a radius of the polishing pad and a width of the first annular region.

DETAILED DESCRIPTION

Figure 1:
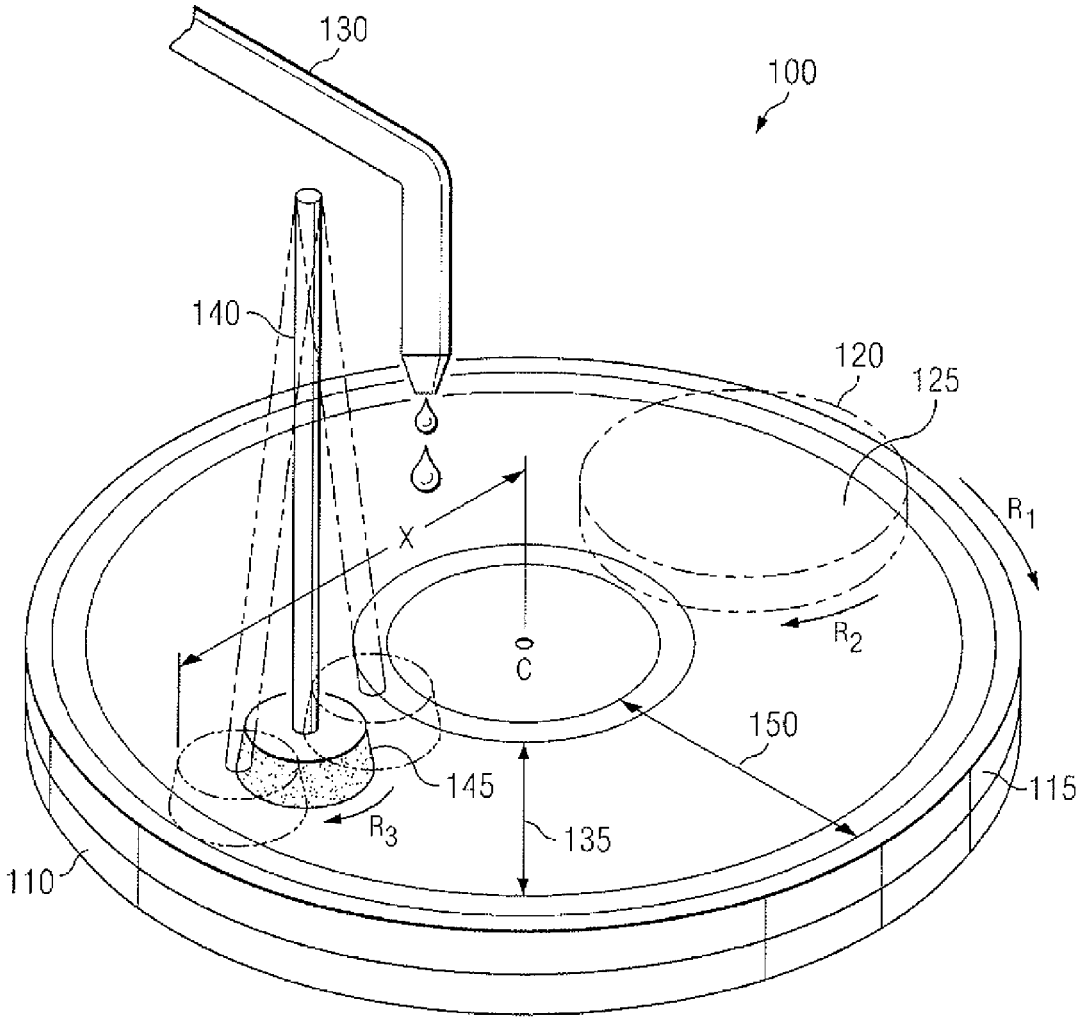
FIG. 1 is a plan view of a CMP apparatus, according to an embodiment of the present invention.

The present invention is described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

Embodiments of the invention describe mechanical polishing (MP) systems incorporating in situ polishing pad conditioning that provides substrate surfaces having reduced defect densities. As used herein, a "mechanical polishing system" refers to both chemical and non-chemical MP systems. In a conventional MP system with in situ conditioning, such as a CMP system, the polishing pad is generally configured as a large spinning or rotating disk. In one sector of the disk, a surface of a substrate (e.g., a semiconductor comprising wafer) to be polished is positioned against the polishing pad such that the polishing pad, either directly and/or via a chemical slurry, abrades the substrate surface to provide the desired polishing. In another sector of the disk, a conditioning pad, also typically rotating, is positioned to condition the surface of the polishing pad, either directly or via the chemical slurry, by abrading the surface of the polishing pad. Consequently, the pad conditioning process reduces the thickness of the polishing pad. However, to achieve the high level of planarization and the polishing thickness control generally required for advanced IC manufacturing processes, control of the thickness of the polishing pad is required. Therefore, to provide uniform conditioning of the polishing pad, the conditioning pad is generally configured to simultaneously move over the surface of the of the polishing pad in a predetermined pattern that improves uniformity.

Unfortunately, conventional MP systems, such as CMP systems, with such conditioning pads still generally fail to provide uniform conditioning of the polishing pads. This is due in large measure to the current configuration of existing MP tools. For example, a typical CMP tool for polishing 8 inch diameter silicon comprising substrates typically includes a polishing pad having a radius of 10 inches and a conditioning pad having a diameter of 4 inches. As a result, when a conventional 4 inch conditioning pad is rotated and is moved along the 10 inch radius of a conventional polishing pad for 8 inch substrates, the portion of the polishing pad exposed to polishing in multiple direction by the entire surface of the conditioning pad is limited to an annular region having a width of 6 inches, 2 inches less than the diameter of the substrate being polished. A "width of an annular region", as used herein, refers to the difference between the outer radius and the inner radius of an annular region. Accordingly, when an 8 inch substrate is polished using such a conventional configuration, the substrate is polished non-uniformly because the entire substrate cannot be positioned within the annular region.

Most conventional methods for improving polishing uniformity focus primarily on improving conditioning pad materials and/or slurry compositions. However, such methods still generally fail to improve polishing uniformity significant, as they do not affect the width of the annular region described above. Some conventional methods exist for adjusting the path of the conditioning pad to improve the width of the annular area described above. In general, these methods provide for moving the conditioning pad partially off the edge of the polishing pad to increase the lateral motion of the conditioning pad. However, the reduced continuous contact with the polishing pad tends to dry up at least a portion of the conditioning pad, resulting in degradation of the conditioning pad and/or introduction of additional particulates into the MP system.

To overcome such limitations, the Present Inventors have discovered that based on the size of the polishing pad of the MP system and the size of the substrate to be polished using the MP system, a conditioning pad size range can be determined which allows the entire surface of the conditioning pad to remain in continuous contact with the polishing pad while significantly improving polishing uniformity for substrates of a particular size. In particular, the Present Inventors have discovered that for conventional disk-based conditioning pads, the range of such conditioning pads can be provided by equation (1):

$$d_{c_pad} \leq r_{p_pad} - d_{sub} \quad (1)$$

where $d_{cpad}$ is the diameter of conditioning pad, $r_{p_pad}$ is the radius of the polishing pad, and $d_{sub}$ is the diameter or width of the substrate (e.g., wafer) being polished. In other words, the equation above provides a pad diameter that can produce an annular region in a polishing pad having an annular width greater or equal to the diameter of the substrate. This will be conceptually described with respect to FIGS. 1 and 2. Although the various embodiments of the present invention will be illustrated with respect to a CMP apparatus, such embodiments are presented by way of example and not by way of limitation. One of ordinary skill in the art will readily recognize that the various embodiments of the present invention are generally applicable to other polishing systems.

FIG. 1 is a plan view of a CMP apparatus 100, according to an embodiment of the present invention. The CMP apparatus 100 illustrated in FIG. 1 includes a polishing platen 110 including a conventional polishing pad 115 located thereon or thereover. The polishing platen 110 (and the polishing pad 115) is generally configured to rotate at least in a rotational direction R1. Positioned over the polishing pad 115 in the embodiment shown in FIG. 1 is a carrier head 120. The carrier head 120, as those skilled in the art will appreciate, is configured to maintain a substrate 125, and in particular a surface of the substrate 125 to be polished (e.g., such as a polishable surface located over a wafer substrate) against the polishing pad 115 at an off center position relative to the polishing pad 115. The term "off center", as used herein with respect to a position of an object relative to the polishing pad, refers to the portion of the object contacting the polishing pad being located entirely within an annular region of the polishing pad 115. The carrier head 120 is also generally configured to rotate the substrate 125 at least in a rotational direction R2. Any known or hereafter discovered substrate having a polishable surface (e.g., interconnect material surfaces, shallow trench isolation material surfaces, etc.) can be used with the various embodiments of the present invention.

The CMP apparatus 100 illustrated in FIG. 1 further includes a slurry delivery source 130 positioned over and off center the polishing pad 115. In the exemplary embodiment of the present invention shown in FIG. 1, the slurry delivery source 130 dispenses the slurry at least within boundaries of a first annular region 135 defined by the area the substrate 125 contacting the polishing pad 115. In these embodiments of the present invention, the slurry delivery source 130 is configured to provide a desired (e.g., metered) amount of slurry to the polishing pad 115 during the polishing of the polishable surface of the substrate 125. Any type or composition of slurry generally may be used with the various embodiments the present invention.

The CMP apparatus 100 additionally includes a conditioning device 140 for positioning a conditioning pad 145 over and off center relative to the polishing pad 115. As those skilled in the art are generally aware, the conditioning pad 145 is designed to condition the polishing pad 115 on the polishing platen 110, thus extending the effective useful lifespan of the polishing pad 115 prior to replacement. The conditioning device 140 is configured to both rotate and laterally move the conditioning pad 145 across the polishing platen 110. In the exemplary CMP apparatus in FIG. 1, the conditioning pad 145 can rotate in at least a rotational direction R3 and can laterally move within a distance X1 along an axis extending from the rotational center (C) of the polishing pad 115. In FIG. 1, the lateral motion for conditioning pad 140 is provided by configuring a pendulum-type mechanism for conditioning device 140. However, such a configuration is shown by way of example and not by way of limitation. In the various embodiments of the present invention, any type of mechanism generally can be used to provide lateral motion of the conditioning pad 145.

In the various embodiments of the present invention, the lateral motion and rotation of the conditioning pad 145 results in at least one portion of the conditioning pad 145 contacting the polishing pad 115. As shown in FIG. 1, this results in the conditioning pad 145 contacting the polishing pad within a second annular region 150. However, even though the conditioning pad 145 contacts all portions of second annular region 150, not all portions of second annular region 150 are uniformly conditioned. In particular, since the areas of second annular region 150 outside of first annular region 135 are exposed to polishing in one or more primary directions of rotation, the polishing pad 115 is polished differently in first annular region 135 as compared to areas outside second annular region 150. This is conceptually described with respect to FIG. 2.

Figure 2:
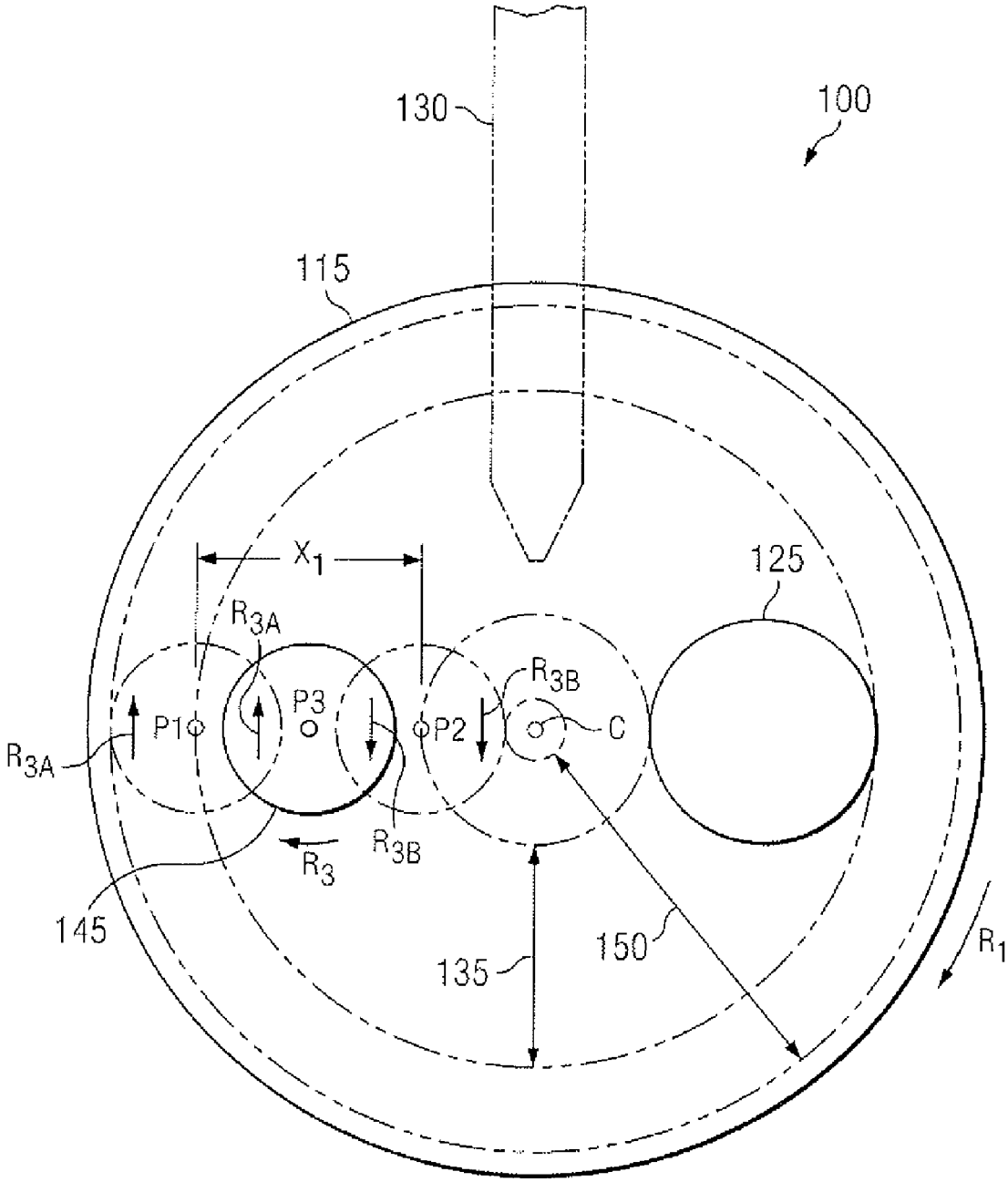
FIG. 2 is a partial top-down view of the CMP apparatus shown in FIG. 1.

FIG. 2 shows a partial top-down view of the CMP system 100 in FIG. 1. As described above for FIG. 1, the conditioning pad 145 is configured to laterally move a distance X1. As a result, the conditioning pad 145 is laterally and repeatedly moved between endpoints defined a first center position P1 for the conditioning pad 145 and a second center position P2 for the conditioning pad 145, and vice versa, during a CMP process. Between positions P1 and P2, the conditioning pad is laterally moved between a plurality of intermediate center positions P3 for the conditioning pad 145. As previously described, during a CMP process in system 100, the conditioning pad is also configured rotate in at least a rotational direction R3. As a result, as conditioning pad 145 is laterally moved over a region of the polishing pad 115, the conditioning uniformity for the selected region will generally vary as the primary direction of rotation of the conditioning pad 145 varies.

For example, as conditioning pad 145 laterally moves between positions P1 and P2, the amount of conditioning uniformity will vary. For example, at position P1, the portion of second annular region 150 farthest from the rotation center C and outside first annular region 135 will principally be exposed to the conditioning pad 145 rotating in primarily rotational direction R3A. Similarly at position P2, the portion of second annular region 150 closest to the rotation center C and outside first annular region 135 will principally exposed to the conditioning pad 145 rotating in primarily rotational direction R3B. As a result of the rotation in primarily one direction observed at both of these two points, the amount of conditioning is limited. In contrast at positions P3, as the conditioning pad 145 sweeps across the polishing pad, the surface of the polishing pad is exposed to the conditioning pad 145 rotating in both directions R3A and R3B. As a result, the amount of conditioning is significantly increased in these positions, improving polishing of the substrate 125 by regions of the polishing pad 115 associated with positions P3, namely first annular region 135.

Therefore, an area associated with a current position of the conditioning pad 145 will generally not be uniformly conditioned unless the available travel distance to both positions P1 and P2 is greater than or equal to the diameter of the conditioning pad 145. That is, the conditioning pad 145 needs to be able to completely pass a point as the conditioning pad 145 is laterally moved in order for the point to be exposed to rotation in both rotational directions R3A and R3B. Accordingly, for a conditioning pad 145, the distance X1 generally needs to be greater than or equal to the diameter of the conditioning pad and defines the minimum width for first annular region 135. As a result, the outer radius of the second annular region 150 is always greater than the outer radius of first annular region 135 by ½ of the conditioning pad diameter and the inner radius of the second annular region 150 is always less than the inner radius of first annular region 135 by ½ of the conditioning pad diameter.

Accordingly, the Present Inventors have discovered that since the width or diameter of a substrate 125 is generally a known quantity and the width of the first annular region 135 provided by a particular size of conditioning pad 145 for a polishing pad 115 can be estimated, a maximum diameter for the conditioning 145 can be calculated. In particular, by selecting the minimum width of the first annular region 135 as the diameter of the substrate 125 in equation (1), the minimum width of the first annular region 135 and the polishing pad radius can be utilized to directly calculate the maximum conditioning pad diameter as shown in equation (2):

$$d_{c_pad} \leq r_{p_pad} - w_{min_annular} \tag{2}$$

where $d_{c_pad}$ is the diameter of conditioning pad, $r_{p_pad}$ is the radius of the polishing pad, and $w_{min_annular}$ is the minimum width of an annular region of the polishing pad containing the substrate (e.g., wafer) being polished. As a result, when the diameter for conditioning pad 145 is selected in such a manner, as the conditioning pad 145 sweeps across the polishing pad 115, a first annular region 135 having improved conditioning (and thus polishing) uniformity is provided and is of a sufficient width to provide a more uniform polishing surface for substrate 125.

Figure 3:
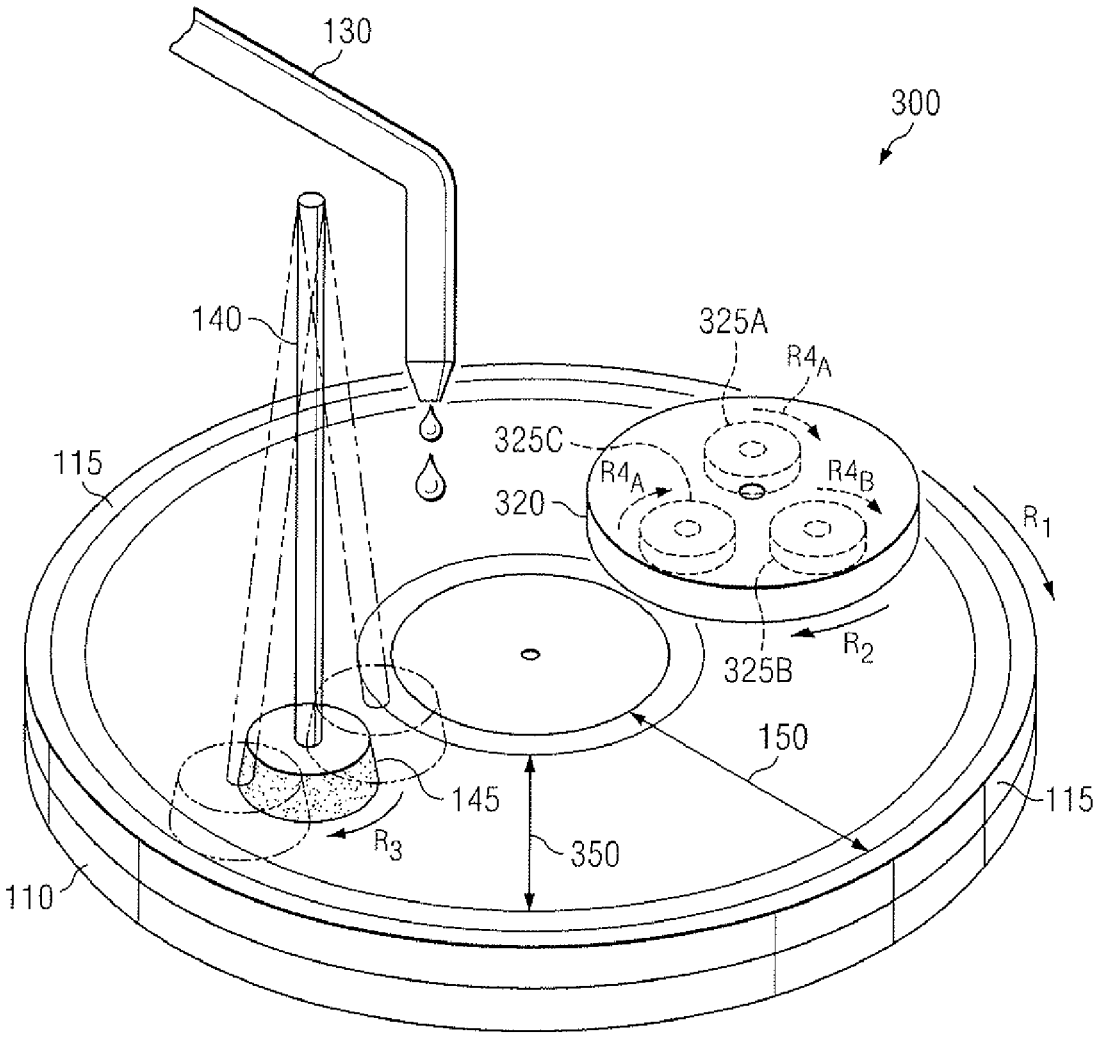
FIG. 3 is a plan view of a CMP apparatus, according to another embodiment of the present invention.

Although the exemplary embodiment of the CMP apparatus shown in FIGS. 1 and 2 describe a single substrate processing system, this exemplary embodiment is present by way of example and not by way of limitation. In other embodiments of the present invention, multiple substrates can be simultaneously processed. For example, FIG. 3 shows an alternative embodiment of a CMP apparatus 300 manufactured and operated in accordance with the present invention. The CMP apparatus 300 illustrated in FIG. 3 is substantially identical to the CMP apparatus 100 illustrated in FIGS. 1 and 2 with the exception that the carrier head 320 is designed to maintain multiple substrates 325A-325C, each wafer having a polishable surface, against polishing pad 115. In addition a individual and/or independent rotation R4A-R4C can be provided for each of substrates 325A-325C, respectively, in carrier head 320.

Figure 4:
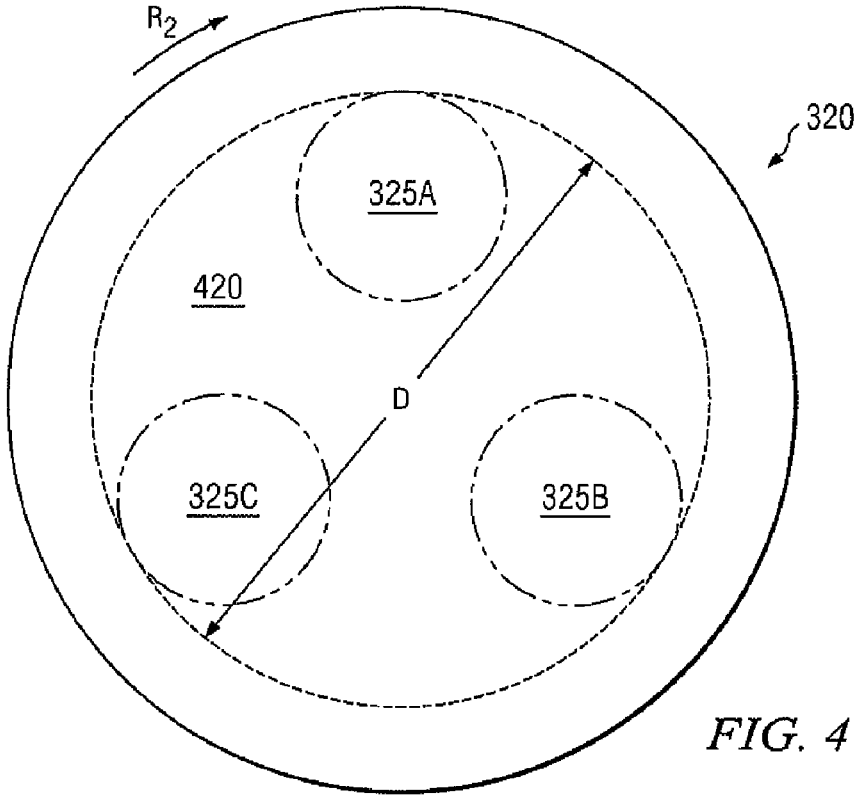
FIG. 4 is a top-down view of the carrier head of the CMP apparatus shown in FIG. 3.

In such embodiments, the minimum width for first annular region 350 to be used for calculating the pad diameter for conditioning pad 145 can be based on the combined area of the covered by the substrates 325A-325C during rotation of the carrier head in rotational direction R2. For example, as shown by the top-down depiction of the carrier head 320 in FIG. 4, the width to be used would be the diameter (D) of minimum area circle 420 enclosing the substrates 325A-325C.

Figure 5:
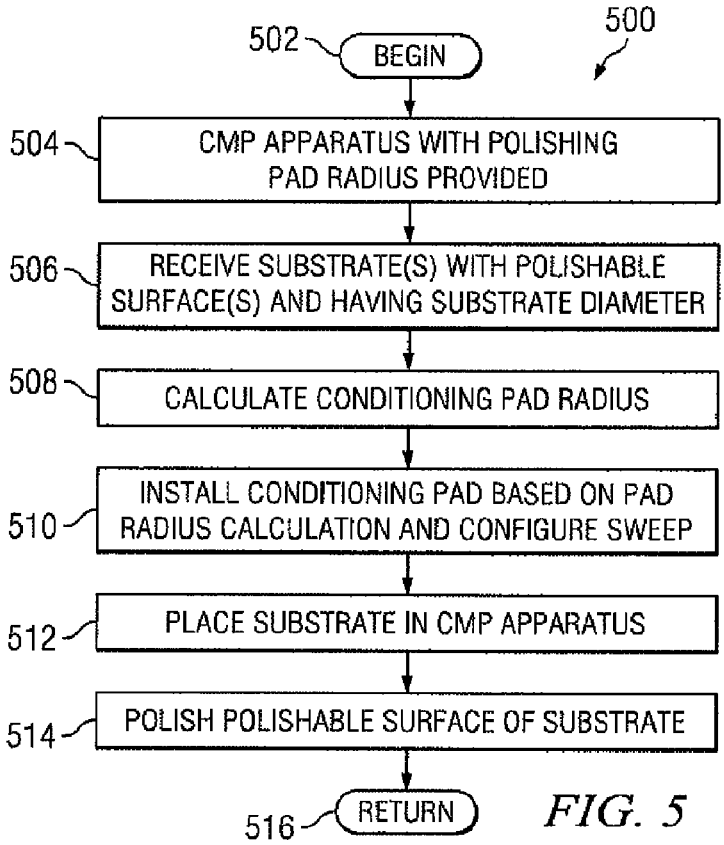
FIG. 5 is a flowchart of steps in an exemplary method for configuring a CMP apparatus, according to an embodiment of the present invention.

FIG. 5 shows a flowchart of an exemplary method 500 for configuring a CMP apparatus and polishing surfaces therewith. The method begins in step 502 and continues on to step 504. In step 504, a CMP apparatus is provided having a polishing pad radius. In step 506, at least one substrate (e.g., a wafer) is received having a polishing surface. The width of the first annular region can then be calculated in step 508. That is, based on the polishing pad radius and a substrate diameter or width, the width of the first annular region can be selected, as described above. Alternatively, in embodiment including a carrier head for multiple substrates, as described above for FIG. 3, the width of the first annular region can be calculated as described above in FIG. 4. Afterwards, based on the conditioning pad diameter calculation in step 508, in step 510 a conditioning pad is installed in the CMP apparatus and the CMP apparatus can be configured to sweep the conditioning pad across the surface of the polishing pad, as described above, to provide an annular region having a width greater than or equal to the substrate diameter. That is, a conditioning pad is installed that has a diameter less than or equal to the pad diameter calculated in step 508. Afterwards, the substrate can be placed in the CMP apparatus in step 512 and the polishable surface of the substrate can be polished in step 514. The method can then end in step 516 and resume previous processing.

Figure 6:
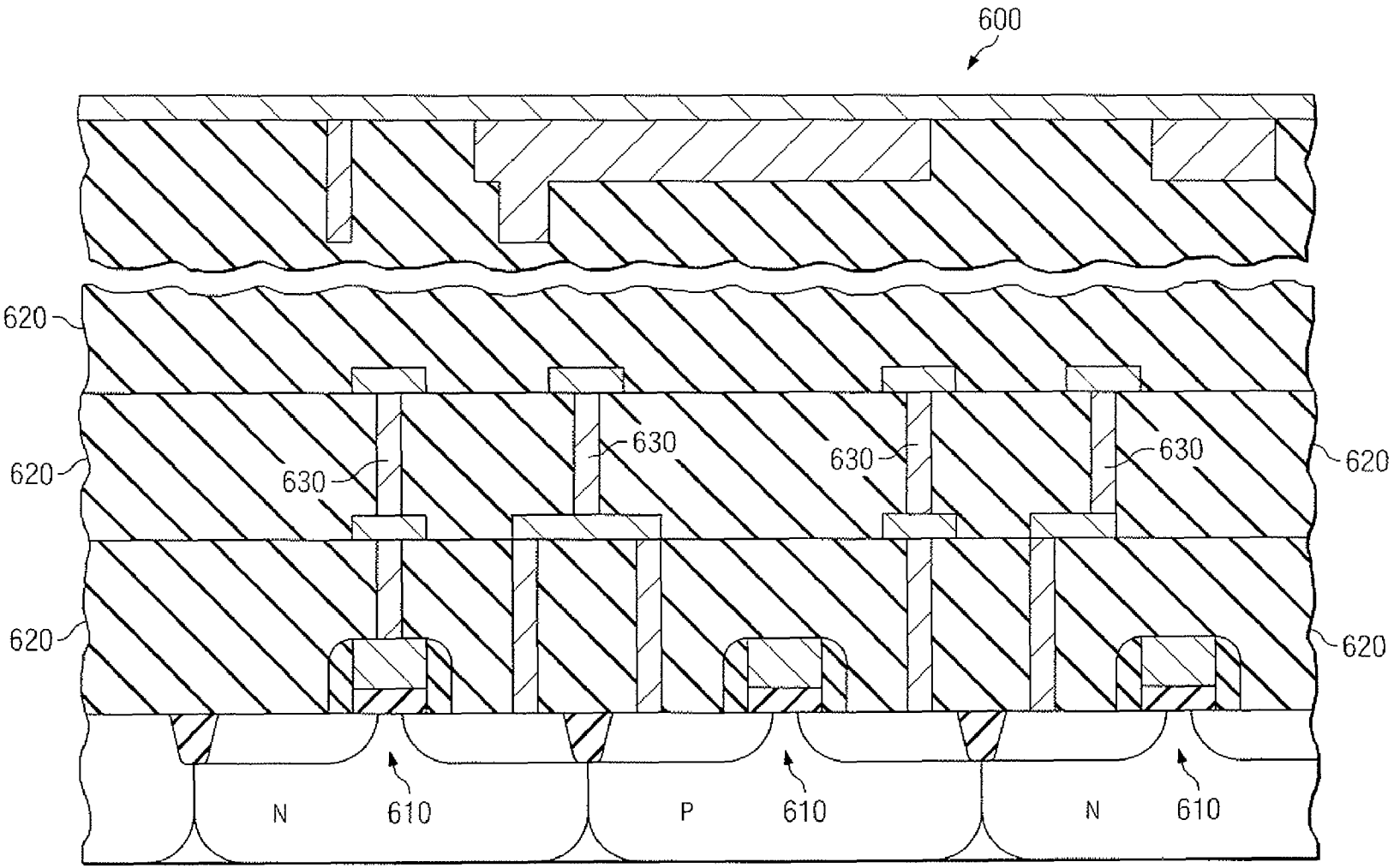
FIG. 6 is an exemplary cross-sectional view of an IC manufactured using a CMP apparatus constructed, configured, and/or operating in accordance with an embodiment of the present invention.

Referring now to FIG. 6, illustrated is an exemplary cross-sectional view of an integrated circuit (IC) 600 manufactured using a CMP apparatus constructed and/or operated in accordance with the principles of the present invention. The IC 600 may include devices, such as transistors used to form CMOS devices, BiCMOS devices, bipolar devices, as well as other types of devices. The IC 600 may further include passive devices, such as inductors, capacitors, or resistors, or it may also include optical devices or optoelectronic devices. Those skilled in the art are familiar with these various types of devices and their manufacture. In the particular embodiment illustrated in FIG. 6, the IC 600 includes the semiconductor devices 610 having dielectric layers 620 located thereover. Additionally, interconnect structures 630 are located within the dielectric layers 620 to interconnect various devices, thus, forming the operational integrated circuit 600. The CMP apparatus or method of operation described above may be used to form a number of different features in the IC 600, including the interconnect structure 630.

EXAMPLES

The following non-limiting Examples serve to illustrate selected embodiments of the invention. It will be appreciated that variations in proportions and alternatives in elements of the components shown will be apparent to those skilled in the art and are within the scope of embodiments of the present invention.

Figure 7:
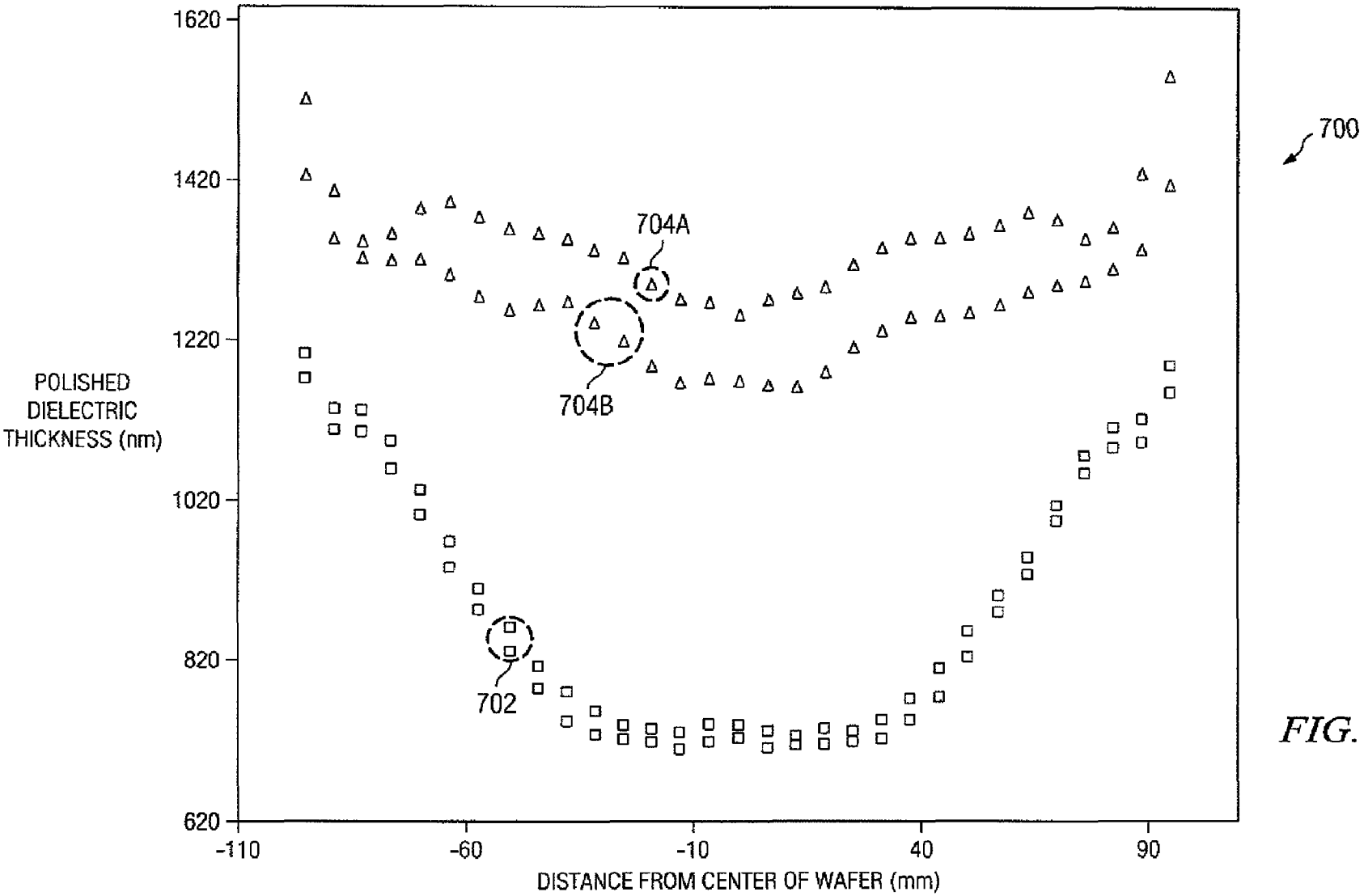
FIG. 7 is a x-y plot of polished dielectric thickness versus distance from the center of an 8 inch (200 mm) wafer for wafers polished using a CMP system include a conventional conditioning pad configuration and a condition pad configuration in accordance with an embodiment of the present invention.

FIG. 7 shows a x-y plot 700 of polished dielectric thickness versus distance from the center of an 8 inch (200 mm) wafer for CMP-polished wafers using a first conditioning pad configuration (conventional conditioning pad) and a second conditioning pad configuration (conditioning pad in accordance with an embodiment of the present invention). The first conditioning pad configuration utilizes a conventional 4 inch diameter conditioning pad and a 20 inch diameter polishing pad. The second conditioning pad configuration utilizes a 2 inch diameter conditioning pad and a 20 inch diameter polishing pad. For the second conditioning pad configuration, the diameter for the conditioning pad was selected according to equation (1). That is, $d_{c_pad}=r_{p_pad}-d_{sub}=(20/2)-(8)=2$ inch conditioning pad diameter.

In plot 700, the data for the first or conventional conditioning pad configuration (4 inch) is represented by data points 702 (open squares) representing first and second measurements. As shown in plot 702, these data points vary from approximately 720 nm to 1200 nm. As a result, the variation in dielectric thickness from center to edge is between 450 nm and 500 nm. In contrast, the second conditioning pad configuration (2 inch) provides significantly less variation. The data for the second conditioning pad configuration is represented by data points 704*a* and 704*b* (closed triangles) also representing first and second measurements, respectively. As shown in plot 700, the data points 704*a* vary from approximately 1250 nm to 1520 nm and data points 704*b* vary from approximately 1150 nm to 1420 nm. As a result, the variation in dielectric thickness from center to edge is between 250 nm and 300 nm for these data points. Therefore, as shown in FIG. 7, replacement of the conventional 4 inch conditioning pad with a conditioning pad selected according to equation (1), i.e., a 2 inch conditioning pad, results in a reduction in center to edge dielectric thickness variation of approximately 40%.

The semiconductor substrates may include various elements therein and/or layers thereon. These can include barrier layers, other dielectric layers, device structures, active elements and passive elements including source regions, drain regions, bit lines, bases, emitters, collectors, conductive lines, conductive vias, etc. Moreover, the invention can be used in a variety of processes including bipolar, CMOS, BiCMOS and MEMS.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the following claims.

What is claimed is:

1. A mechanical polishing apparatus, comprising:

a polishing pad;

at least one carrier head positioned over and off center relative to the polishing pad, said carrier head configured for holding at least one substrate against said polishing pad within a first annular region of said polishing pad when said polishing pad is rotating; and at least one conditioning head positionable over and off center relative the polishing pad at a plurality of first positions, said conditioning head configured for applying a contacting surface of at least one conditioning pad against said polishing pad when said polishing pad is rotating, said conditioning pad applied to a second annular region of said polishing pad and moving between said plurality of first positions, wherein a diameter of said conditioning pad ≦a difference between a radius of said polishing pad and a width of said first annular region wherein the first annular region is defined by the area of the substrate contacting the polishing pad, and wherein the second annular region is defined by:

a) the area of the conditioning pad contacting the polishing pad; and b) is furthermore equal to or greater than the width of the first annular region summed with the diameter of the conditioning disk.

2. The mechanical polishing apparatus of claim 1, wherein said width of said first annular region ≧a width of said substrate.

3. The mechanical polishing apparatus of claim 1, wherein said at least one substrate comprises a plurality of substrates, and wherein said carrier head is configured for holding said plurality of substrates against said polishing pad, and wherein a width of said first annular region is greater than a diameter of a minimum area circle enclosing said plurality of substrates.

4. The mechanical polishing apparatus of claim 1, wherein a width of said first annular region >said conditioning pad diameter.

5. The mechanical polishing apparatus of claim 1, wherein said contacting surface of said conditioning pad remains in continuous contact with said second annular region during said moving between said plurality of first positions.

6. The mechanical polishing apparatus of claim 1, wherein said conditioning head comprises at least one of a swinging conditioning head and a sliding conditioning head.

7. The mechanical polishing apparatus of claim 1, further comprising a slurry delivery source positioned over said polishing pad to dispense a slurry for chemical mechanical polishing.

8. A method for fabricating an integrated circuit, the method comprising:

providing at least one substrate having a polishable surface;

polishing the substrate, said polishing comprising:

placing the substrate in a carrier head positioned over and off center relative to a polishing pad at a first position, said carrier head configured for holding said substrate against said polishing pad within a first annular region of said polishing pad when said polishing pad is rotating, rotating the polishing pad, and applying at least one conditioning head over and off center relative to the polishing pad at a plurality of first positions, said conditioning head configured for applying a contacting surface of at least one conditioning pad against said polishing pad, said conditioning pad applied to a second annular region of said polishing pad and moving between said plurality of first positions, wherein a diameter of said conditioning pad ≦a difference between a radius of said polishing pad and a width of said first annular region wherein the first annular region is defined by the area of the substrate contacting the polishing pad, and wherein the second annular region is defined by:

a) the area of the conditioning pad contacting the polishing pad; and b) is furthermore equal to or greater than the width of the first annular region summed with the diameter of the conditioning disk.

9. The method of claim 8, wherein said width of said first annular region ≧a width of said substrate.

10. The method of claim 8, wherein said at least one substrate comprises a plurality of substrates, wherein said carrier head is further configured for holding said plurality of substrates against said polishing pad, wherein said placing further comprises placing two or more of said plurality of substrates in said carrier head, and wherein a width of said first annular region is greater than a diameter of a minimum area circle enclosing said two or more of said plurality of substrates.

11. The method of claim 8, wherein a width of said first annular region ≧said conditioning pad diameter.

12. The method of claim 8, wherein said contacting surface of said conditioning pad remains in continuous contact with said second annular region during said moving between said plurality of first positions.

13. The method of claim 8, wherein said conditioning head comprises at least one of a swinging conditioning head and a sliding conditioning head.

14. A method for configuring a chemical mechanical polishing (CMP) apparatus comprising a polishing pad, at least one carrier head positioned over and off center relative to the polishing pad, and at least one conditioning head positionable over and off center relative the polishing pad at a plurality of first positions, said carrier head configured for holding at least one substrate against said polishing pad within a first annular region of said polishing pad when said polishing pad is rotating, said conditioning head configured for applying a contacting surface of at least one installed conditioning pad against said polishing pad when said polishing pad is rotating, said installed conditioning pad applied to a second annular region of said polishing pad and moving between said plurality of first positions, the method comprising:

based on a radius of said polishing pad and a width of said first annular region, selecting a diameter for a conditioning pad to be installed in said CMP apparatus, wherein said conditioning pad diameter ≦a difference between a radius of said polishing pad and a width of said first annular region, wherein the first annular region is defined by the area of the substrate contacting the polishing pad, and wherein the second annular region is defined by:

a) the area of the conditioning pad contacting the polishing pad; and b) is furthermore equal to or greater than the width of the first annular region summed with the diameter of the conditioning disk.

15. The method of claim 14, wherein said selecting said conditioning pad diameter comprises:

computing a difference between said radius of said polishing pad and said width of said first annular region; and selecting said difference as a maximum value for said conditioning pad diameter.

16. The method of claim 14, wherein said width of said first annular region ≧a width of said substrate.

17. The method of claim 14, wherein said carrier head is configured for holding a plurality of substrates against said polishing pad, and wherein a width of said first annular region is greater than a diameter of a minimum area circle enclosing said plurality of substrates.

18. The method of claim 14, wherein said selecting comprises selecting said conditioning pad diameter ≦said width of said first annular region.

19. The method of claim 14, wherein said contacting surface of said conditioning pad remains in continuous contact with said second annular region during said moving between said plurality of second positions.

20. The method of claim 14, wherein said conditioning head comprises at least one of a swinging conditioning head and a sliding conditioning head.

* * * * *